United States Patent [19]

O'Neil, Sr.

[11] 4,060,184

[45] Nov. 29, 1977

[54] LIQUID DISPENSING CONTAINER

[76] Inventor: Thomas O'Neil, Sr., 10810 S. Trumbull, Chicago, Ill. 60655

[21] Appl. No.: 683,010

[22] Filed: May 4, 1976

[51] Int. Cl.[2] ..... B65D 5/72

[52] U.S. Cl. ..... 222/501; 251/339

[58] Field of Search ..... 222/501, 490, 402.24, 222/402.25; 137/525.1, 522, 846; 251/339

[56] References Cited

U.S. PATENT DOCUMENTS

| | | | |
|---|---|---|---|
| 1,241,352 | 9/1917 | Doering, Jr. et al. | 222/490 X |
| 2,122,299 | 6/1938 | Sloan | 222/490 |
| 2,964,220 | 12/1960 | Appel | 222/501 X |
| 3,104,787 | 9/1963 | Thompson, Jr. | 222/402.24 |

*Primary Examiner*—Stanley H. Tollberg

*Assistant Examiner*—Hadd Lane

*Attorney, Agent, or Firm*—Robert D. Farkas

[57] ABSTRACT

This disclosure pertains to a container having a self closing inexpensive valve located in the lowermost extremities thereof. The valve comprises a pair of resilient sheets having a portion of their surfaces biased in touching engagement by the manner in which the sheets are formed and mounted, and by the pressure exerted on opposed surfaces supplied by the liquid within the container. An elongated rod hingably secured to the container forces the valve-like surfaces into an open position permitting the liquid within the container to be dispensed, utilizing gravity therefor. Removal of the rod from between the valve faces permits the valve to close terminating the liquid discharge.

2 Claims, 4 Drawing Figures

LIQUID DISPENSING CONTAINER

BACKGROUND OF THE INVENTION

1. The Field of the Invention

This invention relates to liquid dispensing containers and more particularly to that class utilizing a self closing manually manipulated valve for dispensing the liquid stored within the container.

2. Description of the Prior Art

The prior art abounds with devices having a container on which a valve is provided. U.S. Pat. No. 3,221,943 issued on Dec. 7, 1965 to G. C. Anderson teaches a container with a valve operated nozzle with an inexpensive valve mechanism affixed thereto. This invention utilizes a rigid container and a soft pliable bag, containing the liquid, mounted therewithin. A spout, fitted to the bag, protrudes through an opening in the container and is operated into opened and closed position by a mechanism affixed to the container. U.S. Pat. No. 3,499,582 issued on Mar. 10, 1967 to S. Berney and U.S. Pat. No. 3,453,033 issued on July 1, 1969 to D. D. Goss both teach substantially similar concepts to that of Anderson with the major deviation residing in the type of valve employed. All of the aforementioned patents suffer the common deficiency of requiring the use of a liner bag as opposed to a unitary liquid containing device whose innermost walls provide the liquid storage container as well as the location for a dispensing valve.

SUMMARY OF THE INVENTION

A primary object of the present invention is to provide an inexpensive unitary valve and container assembly for the storage and dispensing of liquids contained therewithin.

Another object is to provide a self sealing valve which inherently operates into the closed position without requiring additional manually applied forces therefor.

Still another object is to provide a container having a valve located in its lowermost extremities for utilizing gravity to dispense the liquid stored within the container.

Yet another object is to provide a valve which tends to close the valve operating members more securely when the level of liquid stored within the container is increased.

A self closing "flapper" or "butterfly" valve, fabricated from thin layers of plastic so as to be normally biased in the closed position, can be further aided into the closed position by the application of fluid forces on the outermost surfaces of the flexible sheets comprising the valve. This novel valve when secured to the interior surface of a container, is immersed in the liquid contained therewithin. The liquid is dispensed by manually operating the touching faces of the valve into an open position.

The container, during shipment, may experience compressive forces on the outermost surfaces. These forces, utilizing hydraulic principles, are converted into increased compressive forces acting on the valve so as to more firmly secure the valve into a closed position, thereby limiting, if not preventing, accidental leakage.

Since the valve material and the container may be fabricated from inexpensive plastic materials, a disposable unitary package is available, utilizing, if desired, conventional heat sealing techniques for the fabrication process.

These objects, as well as other objects of the present invention, will become more readily apparent after reading the following description of the accompanying drawings.

DESCRIPTION OF THE PREFERRED EMBODIMENT

The structure and method of fabrication of the present invention is applicable to a flexible valve member fabricated into an elongated hollow passageway having one wide end adapted with a radial flange and a narrow end in which the walls of the passageway contact each other. The wide end of the flexible passageway is secured about thd marginal edges thereof, to an opening in a container. The elastic properties of the walls of the passageway are pre-stressed and causes the walls thereof to resiliently contact each other, at the narrow end, so as to form a self closing valve. When the container is pressurized, either by compressing its sides or by the introduction of fluids therein, the flexible valve member tends to more securely close. The application of an opening force, applied through the open end of the valve member, tends to force the valve open by overriding the closing forces stored within the flexible material's memory and the forces caused by the head pressure of the liquid. A tapered rod hingably affixed to the walls of the container is manually pivoted in touching engagement with the interior surfaces adjacent the closed touching walls of the valve member when it is desired to dispense the liquid located within the container. The valve and tapered opening rod is positioned in the area of the lowermost extremity of the container thereby permitting the force of gravity to dispense the liquid, when the valve is manually opened, and to aid in the maintaining of the valve in a closed condition at all other times.

Figure 1:
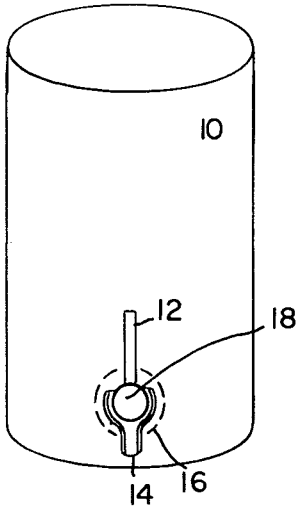
FIG. 1 is a perspective view of the instant invention.

Now referring to the Figures, and more particularly to the embodiment illustrated in FIG. 1 showing a container 10 to which a valve operating arm 12 is hingably affixed. Drip spout 14 provides a path for the liquid, not shown, transitting flexible valve member 16 when opened. Tapered rod 18 is secured to valve operating arm 12 and is utilized to open flexible valve member 16.

Figure 2:
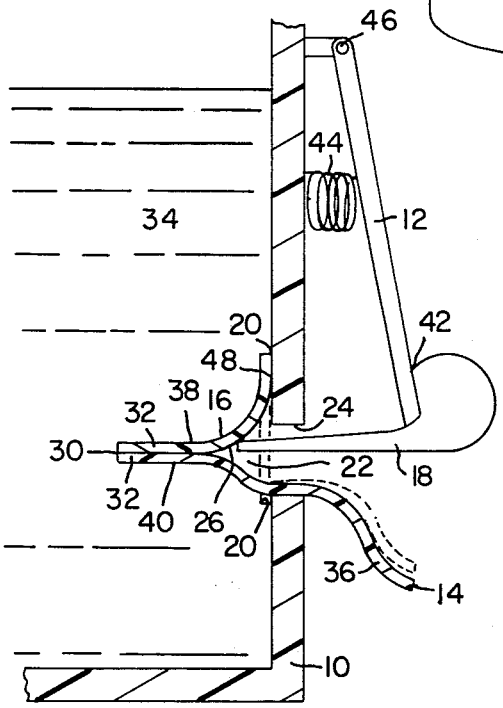
FIG. 2 is a partial side elevation cross-sectional view of the valve and a portion of the container depicted in FIG. 1.

FIG. 2 illustrates a portion of container 10 to which flexible valve member 16 is affixed at marginal edges 20 thereof. Void 22 and opening 24, in the container wall, permits tapered rod 18 to engage surface 26 when directed in the direction of arrow 28. The line 30, formed by the compressive engagement of flexible valve portions 32 of flexible valve member 16, is caused to open permitting liquid 34 to transit flexible valve member 16 and to be dispensed downwardly along surface 36 of drip spout 14.

Flexible valve portions 32 of flexible valve member 16 are caused to close by the fluidly acting forces in the directions of arrows 38 and 40 as well as the inherent closing forces built into the thermoplasticly derived memory of flexible valve member 16 when thermoformed into the desired shape. Flexible valve member 16 is heat to container 10 at points 20, along the marginal edge comprising a flange 48 of one end of flexible valve member 16.

Tapered rod 18 is fixedly secured to valve operating arm 12 at point 42 and is biased outwardly from container 10 by helical spring 44. Valve operating arm 12 is hingably affixed to container 10 at pivot point 46.

Figure 3:
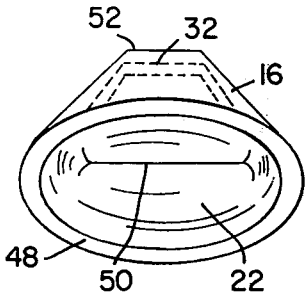
FIG. 3 is a perspective view of the self sealing portion of the valve utilized in FIG. 2.

FIG. 3 shows flexible valve member 16 having flange 48 and opening 22 at one end, and flexible valve portions 32 at the other closed end. Joining line 50 denotes where the innermost surfaces of flexible valve member 16 touch each other forming one end of flexible valve portions 32 and having closed end 52 at the other end thereof.

Figure 4:
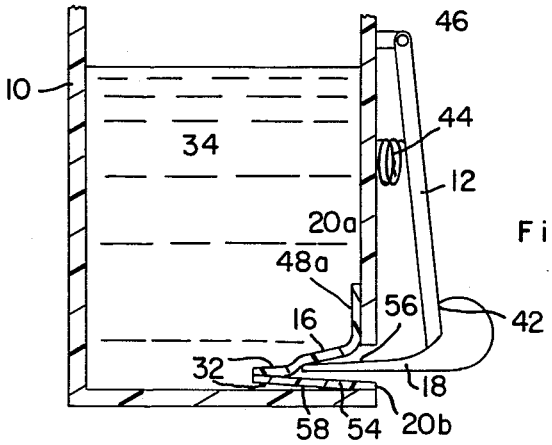
FIG. 4 is a partial cross-sectional view of a container and a valve mechanism mounted at the lowermost extremity of the container.

FIG. 4 illustrates a modified version of flexible valve member 16 from that shown in FIG. 3. Flange 48 as shown in FIG. 3 is distorted into a semi-circular flange portion **48*a* joining container 10 at point 20*a* at the vertical surface thereof and is adapted with a flat surface 54 joining the floor of container 10 at point 20*b*. Hydraulic forces derived from liquid 34 act on flexible valve portions 32 causing flexible valve member 16 to close, opened only by the introduction of end 56 of tapered rod 18 contacting surface 58**, causing a displacement and the attendant opening of the valve.

One of the advantages is to provide an inexpensive unitary valve and container assembly for the storage and dispensing of liquids contained therewithin.

Another advantage is a self sealing valve which inherently operates into the closed position without requiring additional manually applid forces therefor.

Still another advantage is a container having a valve located in its lowermost extremities for utilizing gravity to dispense the liquid stored within the container.

Yet another advantage is a valve which tends to close the valve operating members more securely when the level of liquid stored within the container is increased.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invetion is to be limited, not by the specific disclosure herein, but only by the appending claims.

The embodiment of the invention in which an exclusive privilege or property is claimed are defined as follows:

1. The liquid dispensing container comprising a container for the storage of liquid therein, said container having an opening, self closing valve means for selective dispensing of said liquid from said container, said valve means fixedly secured to the interior surface of said container adjacent the entire marginal edges of said opening, said valve means self biased into a closed position preventing said dispensing of said liquid, said valve means responsive to the presence of said liquid within said container, said liquid when within said container urging said valve means in said closed position, valve opening means for manually manipulating said valve means into an open position, wherein said valve means is heat sealed to said container, wherein said valve means is disposed within the liquid storing portion of said container, wherein said valve means comprises a flexible thermoplastic material having a generally tubular shape, one end of said tubular shape having an outwardly radially extending flange, the other end of said tubular shape having the innermost surfaces adjacent thereto in touching engagement, said innermost surfaces being disposed in said touching engagement by the thermoplastic properties comprising said flexible material, wherein said valve opening means comprises a tapered rod, hinging means for hingeably affixing said tapered rod to the outermost surface of said container, biasing means for biasing said tapered rod outwardly from said outermost surface, said tapered rod being disposed through said opening when said biasing means is manually overridden.

2. The liquid dispensing container as claimed in claim 1, further comprising a liquid directing surface, said liquid directing surface for directing the flow of said liquid discharge from said container along a generally outwardly downwardly extending path from the outermost surface of said container adjacent the lowermost marginal edges of said opening.

* * * * *